US006672020B1

(12) United States Patent
Cermola et al.

(10) Patent No.: US 6,672,020 B1
(45) Date of Patent: Jan. 6, 2004

(54) UNIVERSAL ROOF SCUTTLE

(75) Inventors: Steven G. Cermola, Woodbridge, CT (US); Gary P. Dabrowski, Naugatuck, CT (US)

(73) Assignee: The Bilco Company, West Haven, CT (US)

( * ) Notice: Subject to any disclaimer, the term of this patent is extended or adjusted under 35 U.S.C. 154(b) by 0 days.

(21) Appl. No.: 10/099,108

(22) Filed: Mar. 15, 2002

(51) Int. Cl.[7] ..... E04B 7/18
(52) U.S. Cl. ..... 52/200
(58) Field of Search ..... 52/199, 200, 19, 52/20, 21, 64, 66, 72

(56) References Cited

U.S. PATENT DOCUMENTS 3,934,383 A * 1/1976 Perry et al. ..... 52/200
3,969,858 A * 7/1976 Naidus ..... 52/232
4,781,008 A 11/1988 Lyons, Jr.
4,788,804 A * 12/1988 Haas ..... 52/200
4,796,400 A * 1/1989 Mulder ..... 52/200
4,845,905 A * 7/1989 Frank ..... 52/72
4,930,275 A * 6/1990 Verby et al. ..... 52/200
4,941,300 A 7/1990 Lyons, Jr.
4,986,039 A * 1/1991 Weisner ..... 52/72
5,638,645 A * 6/1997 Lipton ..... 52/72
5,735,086 A * 4/1998 Fordahl ..... 52/19
5,960,596 A 10/1999 Lyons, Sr.
6,493,999 B2 * 12/2002 Lindgren et al. ..... 52/200

* cited by examiner

*Primary Examiner*—Ramon O. Ramirez
*Assistant Examiner*—Kofi Schulterbrandt
(74) *Attorney, Agent, or Firm*—DeLio & Peterson, LLC

(57) ABSTRACT

A roof scuttle is provided which is adapted to be easily installed on any curb on a roof which curb may be existing, pre-formed or formed on the roof at the time of installation. The roof scuttle has a rectangular frame with an outwardly extending drip flange and the bottom of the frame is placed flat on the curb and the inside wall of the frame of the roof scuttle secured to the curb. This eliminates any external fastening of the roof scuttle to the roof which can cause leakage problems and also provides a more secure and safe installation. One embodiment of the roof scuttle uses a wood frame supplied with the roof scuttle which frame is useful for transportation of the roof scuttle and also for installations requiring a wood frame curb. The roof scuttle may be installed over irregular shaped openings, existing roof scuttles, and wide or narrow concrete, wood or metal curbs.

16 Claims, 10 Drawing Sheets

UNIVERSAL ROOF SCUTTLE

BACKGROUND OF THE INVENTION

1. Field of the Invention

This invention relates to horizontal hinged door assemblies such as roof scuttles and, in particular, to roof scuttles which may easily be installed on roof curbs by unskilled labor to replace existing scuttles or on pre-built or built-on-site roof curbs to cover any shape opening on any roof surface and which scuttles are attached to the roof from the inside of the scuttle.

2. Description of Related Art

Horizontal hinged (covers) doors are commonly used for roof scuttles, automatic fire vents, ceiling access doors, basement doors and other access doors. The present invention will be directed for convenience to roof scuttles which are used to provide access to a roof but it will be appreciated to those skilled in the art that the invention is applicable to other horizontal hinged doors and other devices which do not open such as skylights.

Roof scuttles are ruggedly built for long, dependable service and generally comprise a rectangular frame which surrounds the opening to be covered with the frame being hinged to a door for motion of the door between an open and closed position. The conventional roof scuttle has a vertical sheet metal inner wall with an outwardly extending 90° horizontal nailing flange at the bottom of the wall which flange is nailed or otherwise secured to the roof deck through holes provided in the flange. A curb such as a wooden beam forms the outer wall of the frame which is connected to a cap flashing. Roofing materials are then used to waterproof the outer wall of the frame typically by rolling the roofing along the roof surface and then up the vertical walls (curb) of the frame and securing the roofing material to the curb. When the roofing material is secured installation is complete.

Securing the roofing material to the roof scuttle frame requires experienced and skilled labor to properly waterproof the scuttle. A number of patents have issued in this area relating to forming a waterproof seal between a waterproof roofing material and the scuttle frame surrounding a roof opening. In U.S. Pat. No. 5,960,596, a roofing device is shown for sealing the roofing material to a roof scuttle having a curb wherein the roofing material is wrapped over an elongated resilient filler piece which is snuggly inserted into a filler channel between a wall flange and a top flange of the scuttle. A conventional roof scuttle is shown herein in FIG. 2 wherein the inner surface 19*a* of the roof scuttle is bent 90° to form a base flange 23 which may be adhesively sealed and nailed or screwed in a conventional manner to the roof through openings 23*a*. The roof surface and outer wall curb 18*a* of the roof scuttle are covered with a roofing material which is then secured in place against the outer wall 18*a*. Another similar sealing system for a conventional roof scuttle is shown in U.S. Pat. No. 4,941,300. In U.S. Pat. No. 4,781,008 a frame assembly is shown for surrounding an opening in a building surface and for securing a waterproof roofing material to the frame assembly. All the above patents are hereby incorporated by reference.

While standard roof scuttles are designed for easy installation for both new and existing construction, the installation generally requires skilled labor to waterproof the scuttle. To install a new roof scuttle on an existing roof opening, the old scuttle is removed and any surrounding roofing materials removed to expose the existing opening. If the opening is irregular, wood or concrete may be used to properly size the opening to receive the new roof scuttle. The curb is waterproofed and the new scuttle securely fastened to the top of the curb using the nailing flange and a sealant under the flange as required. To complete the installation, roofing materials are then used to waterproof the outer wall of the scuttle as shown in U.S. Pat. No. 5,960,596, supra. Installation of a conventional roof scuttle therefore requires skilled labor, possible modifications to the roof and securing the roof scuttle using an external flange which may leak if not properly waterproofed.

Another problem with existing scuttle designs is that specifications vary in foreign countries and it has been found that the scuttles are improperly mounted on the roof or existing curbs leading to leakage and mechanical difficulties.

Bearing in mind the problems and deficiencies of the prior art, it is one object of the present invention to provide a roof scuttle for enclosing a roof opening which roof scuttle is easily installed by unskilled labor on any size pre-formed curb or curb formed on-site surrounding the roof opening.

It is another object of the present invention to provide a number of methods for installing a roof scuttle to cover a variety of openings in a roof which methods are easily performed by unskilled labor to provide a reliable waterproof seal.

It is an additional object of the present invention to provide a roof scuttle which is secured to a curb on the roof by anchor straps from the inside of the roof scuttle which provide an enhanced waterproof installation and are more secure than conventional scuttles using external fasteners such as nails and screws.

Still other objects and advantages of the invention will in part be obvious and will in part be apparent from the specification.

SUMMARY OF THE INVENTION

The above and other objects, which will be apparent to those skilled in art, are achieved in the present invention which relates in one aspect to a roof scuttle for enclosing a roof opening comprising:

a plurality of elongate rectangular shaped frame members having a vertical outer wall and an opposed vertical inner wall and a connecting horizontal upper wall and a connecting horizontal lower wall and a downwardly and outwardly angled drip flange along the vertical outer wall and preferably at or near the junction of the outer wall and lower wall, which said frame members are connected together to form a rectangular scuttle frame, the scuttle frame having a front and a back and two opposed sides and an opening therebetween;

a hinge;

a door having a top, bottom and side edges, said door being hinged to the frame for motion of the door between an open position and a closed position;

the inner wall of the frame members preferably having openings therein to secure one end of an anchor strap therein with the other end of the anchor strap being secured to a curb surrounding the roof opening; and wherein the lower wall of the frame member is positioned on the curb and secured to the curb and preferably the anchor strap secured to both the inner wall of the frame and to the curb securing the roof scuttle to the curb.

In another aspect of the invention a method is provided for installing a roof scuttle to cover a roof opening comprising the steps of:

providing a curb surrounding a roof opening to be enclosed by a roof scuttle;

supplying a roof scuttle comprising:

a plurality of elongate rectangular shaped frame members having a vertical outer wall and an opposed vertical inner wall and a connecting horizontal upper wall and a connecting horizontal lower wall and a downwardly and outwardly angled drip flange along the vertical outer wall and preferably at or near the junction of the outer wall and lower wall, which said frame members are connected together to form a rectangular scuttle frame, the scuttle frame having a front and a back and two opposed sides and an opening therebetween;

a hinge;

a door having a top, bottom and side edges, said door being hinged to the frame for motion of the door between an open position and a closed position;

the inner wall of the frame members preferably having openings therein to secure one end of an anchor strap with the other end of the anchor strap being secured to a curb surrounding the roof opening; and wherein the lower wall of the frame member is positioned on the curb and secured to the curb and preferably the anchor strap secured to both the inner wall of the frame and to the curb securing the roof scuttle to the curb;

positioning the lower wall of the roof scuttle on the curb; and securing the frame member to the curb preferably by securing one end of the anchor strap in the inner wall of the roof scuttle and the other end to the curb.

In yet another aspect of the invention the roof scuttle frame member is made from two pieces of sheet metal which are configured and secured together to form the frame member. A spacer/brace member is also preferably positioned in the frame opening to strengthen the frame.

In a further aspect of the invention the roof scuttle frame member is formed by extrusion.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(s)

In describing the preferred embodiment of the present invention, reference will be made herein to FIGS. 1–13B of the drawings in which like numerals refer to like features of the invention.

Figure 1:
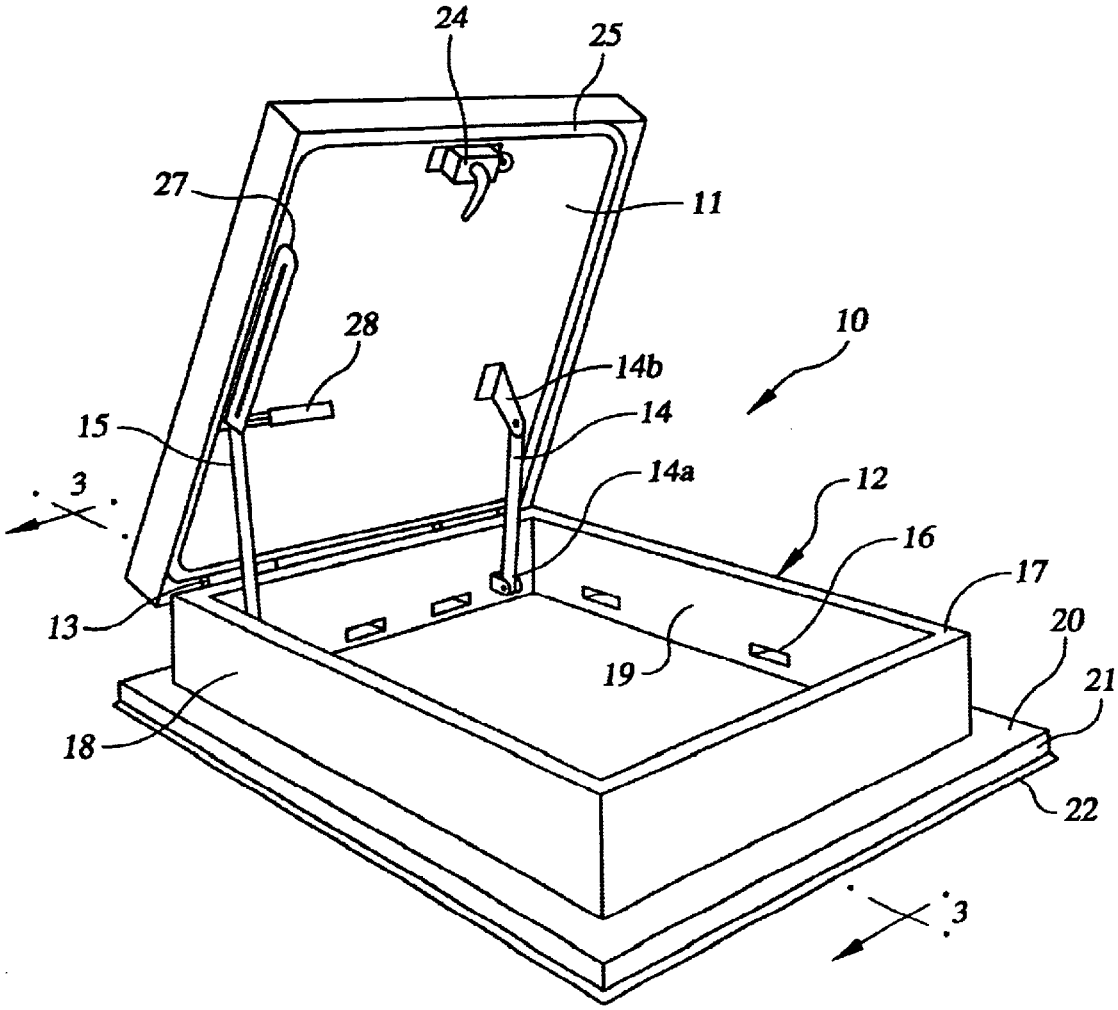
FIG. 1 is a perspective view of a roof scuttle of the invention.

Referring to FIG. 1, a roof scuttle of the invention is shown generally as 10. The scuttle has a cover or door 11 which is hinged by hinge 13 to the roof scuttle frame shown generally as 12. The roof scuttle frame 12 comprises an outer wall 18, a horizontal flange wall or apron 20, a vertical side wall 21 and a downwardly outwardly angled drip flange 22. The frame has a top curb 17 and an inner wall 19. Connecting lower wall 29 is not shown in this view. The inner wall 19 of the frame has openings 16 for accommodating an anchor strap wherein one end of the clip is secured in the opening and the other end secured to a curb on the roof on which the roof scuttle is positioned. The scuttle of the invention also has a spring lift mechanism 14 rotably held by a bracket 14*a* to the inner frame wall 19 and by bracket 14*b* to the door 11 to facilitate opening and closing of the roof door. A rotatable support strut shown as 15 engages L-slot 27 during opening and closing and maintains the roof door of the scuttle in an open position until it is desired to close the roof scuttle door. A door handle is shown as 28. Also shown is a lock 24 and gasket 25 which travels around the door and sits on curb 17 to seal the door when closed.

Figure 2:
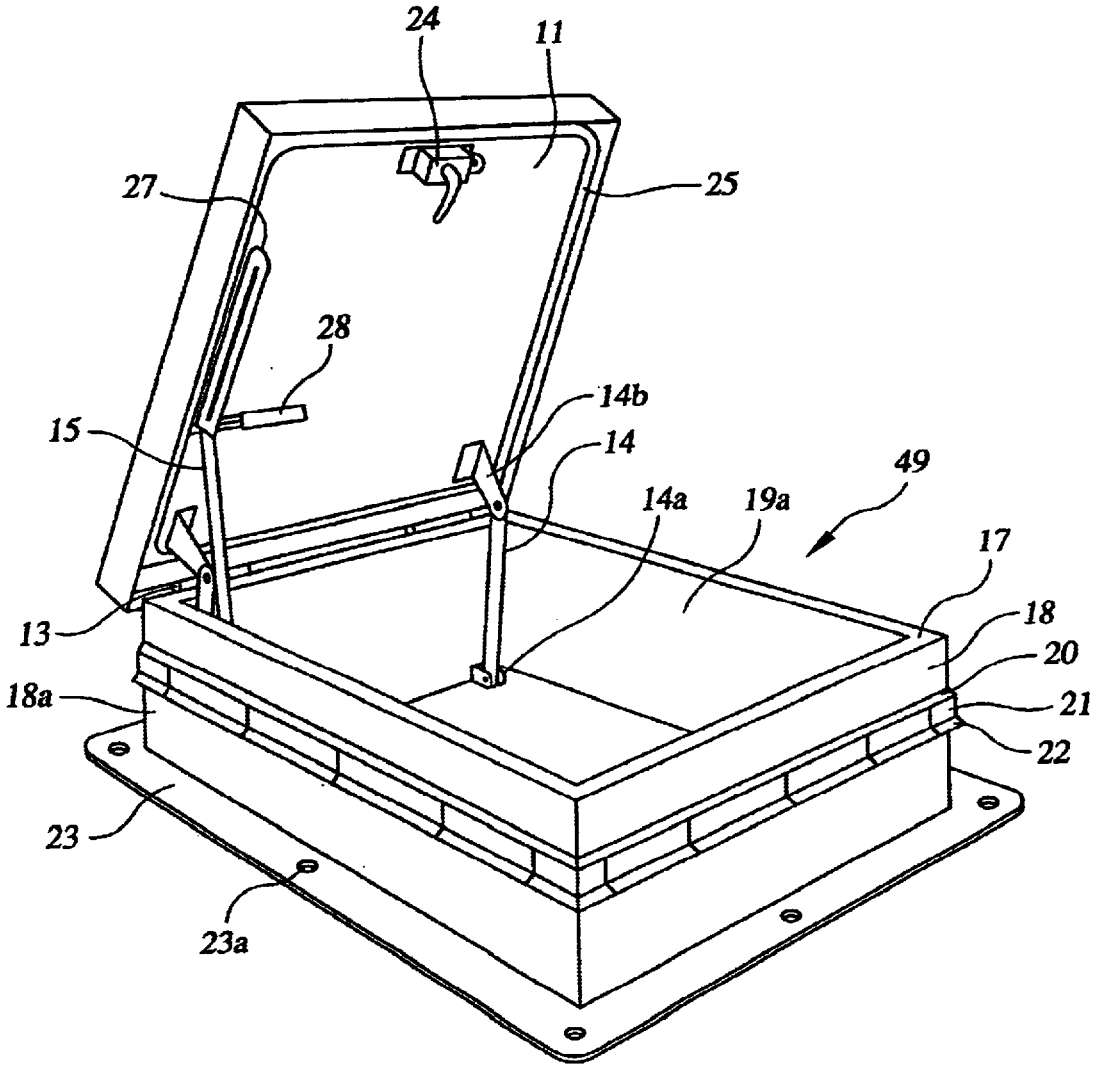
FIG.2 (PRIOR ART)
FIG. 2 is a perspective view of a roof scuttle of the prior art.

Referring to FIG. 2, a roof scuttle of the prior art is shown generally as 49. A horizontal top curb 17 is connected to vertical outer wall 18 and horizontal flange 20 which is connected to a top flange 21 and which ends in a downwardly outwardly extending drip edge flange 22. The prior art roof scuttle has a curb 18*a* ending at nailing flange 23

(with nail openings 23*a*) which nailing flange is formed by bending the inner wall 19*a* 90° at the lower end. The curb 18*a* is typically rigid fiberboard insulation. The roof scuttle has a door 11, lock 24, lift spring mechanism 14 and brackets 14*a* and 14*b* and support strut 15, L-slot 27 and door handle 28 as shown in FIG. 1.

Figure 3:
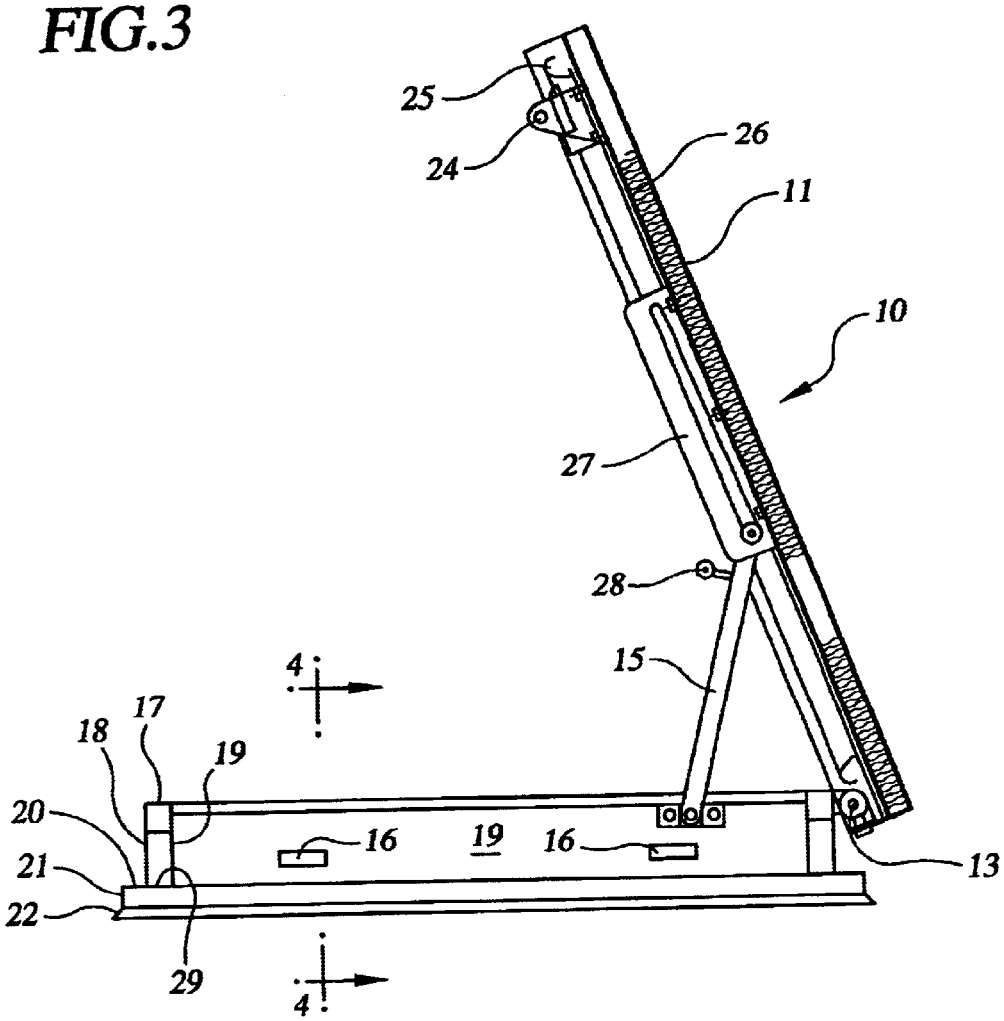
FIG. 3 is an elevational cross-sectional view of FIG. 1 taken along lines 3—3.

Referring now to FIG. 3, a roof scuttle 10 of the invention is shown in an open position whereby support strut 15 is secured in L-slot 27. Door handle 28 would be used to disengage the support strut to close the door 11 when desired.

The door 11 is shown having a hinge 13, insulation 26 and a locking device 24. A gasket 25 travels around the door periphery and seals the door 11 against the roof scuttle curb 17 of the frame when closed.

The frame comprises a horizontal curb 17, an outer wall 18, a horizontal flange wall or apron 20, a vertical side wall 21 and a downwardly outwardly extending drip edge flange 22. The frame has an inner wall 19 and lower wall 29. The inner wall contains openings 16 preferably in the form of slots which are used to secure an anchor strap for fastening the frame of the roof scuttle to a curb on the roof. The openings may also be circular to accommodate anchor straps made from wire or rod. It is also contemplated herein that the frame can be secured to the curb by driving a fastener through the inner wall and connecting lower wall into the curb.

Figure 4:
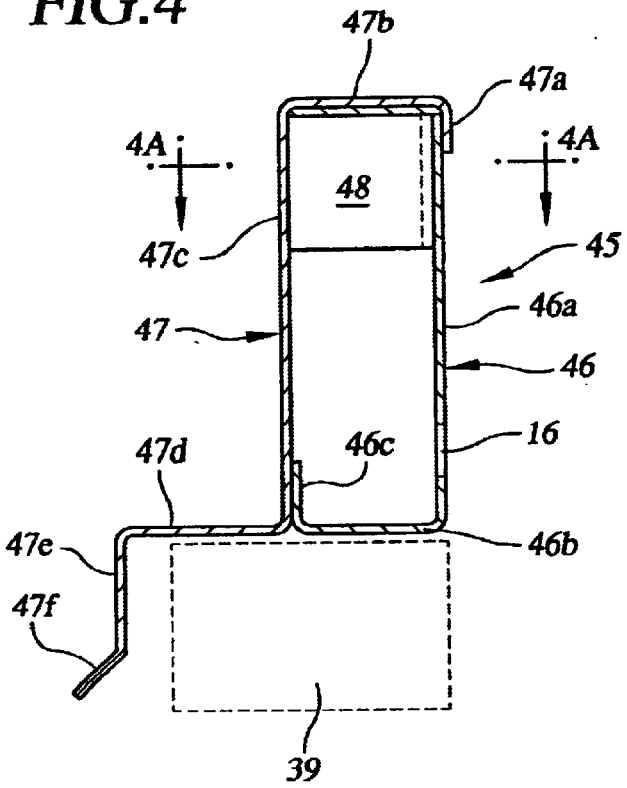
FIG. 4 is a cross-sectional view taken along lines 4—4 of FIG. 3 showing the cross-section of a frame member of a roof scuttle of the invention fabricated from sheet metal and including, in phantom, a wood frame which is used in shipping the roof scuttle and which can also be used to frame the roof opening for installation of the roof scuttle.
Figure 4A:
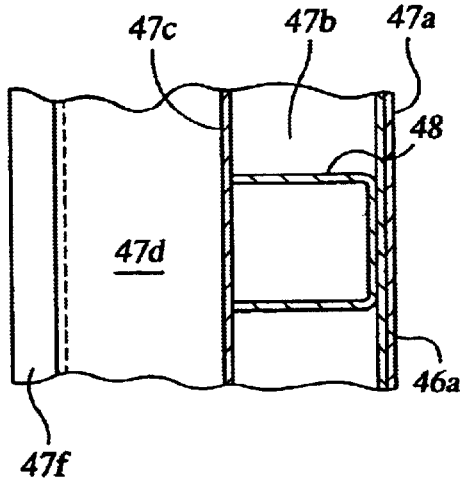
FIG. 4A shows a plan cross-sectional view taken along lines 4A—4A of FIG. 4.

FIG. 4 shows a cross-sectional view of a frame member of a scuttle of the invention made from two sheets of metal bent to the desired configuration. The frame member shown generally as 45 comprises a single piece of sheet metal shown generally as 46 bent in a J-shaped configuration having a vertical inner wall 46*a*, a horizontal lower wall 46*b* and a slightly extending upward vertical wall 46*c*. The other piece of sheet metal shown generally as 47 is bent to form a downwardly extending portion 47*a*, a horizontal curb 47*b*, a vertical outer wall 47*c*, a horizontal apron flange 47*d*, a vertical flange 47*e* and an outwardly downwardly extending drip edge flange 47*f*. Sheet metal pieces 46 and 47 are secured together by welding or other means at contact points of the sheet metal pieces to form the frame shown in the figure. A short U-shaped support 48 is secured to the frame at points along the frame wall (typically at 12 inch intervals) to provide a spacer and to strengthen the frame. Rigid fiberglass insulation is usually in the interior of the frame. FIG. 4A shows the support spacer 48. Openings 16 are provided in the inner wall 46*a* of the frame for accommodating anchor straps used to secure the frame to a roof curb. Openings are not needed but are preferred to facilitate securing the frame. Anchor straps can be secured to the frame and curb on-site by driving the fastener through the anchor strap and the frame. A pre-formed opening in the frame is preferred to secure the anchor strap.

A joiner frame 39 positioned below the lower wall 46*b* and apron 47*d* of the frame is shown in phantom. Such a frame is preferably used in shipping to prevent damage to the roof scuttle frame, apron and drip edge and has utility for framing the opening in the roof, to form a curb where one does not exist or where existent structure is not adequate to accommodate the roof scuttle or to facilitate connecting the roof scuttle to an existing roof hatch device with minimal effort and skill. The joint frame 39 may be constructed from wood, plastic, a composite, metal or any suitable material and may have insulating capability. The joiner frame 39 may be constructed with sealant or sealing capability via gaskets or other elastomeric device and may have the means to adjust the roof opening to provide a surface that is flat, plumb and square as is known by practitioners of the art for the purpose of accommodating the installation of the roof scuttle with minimal effort and skill.

Figure 4B:
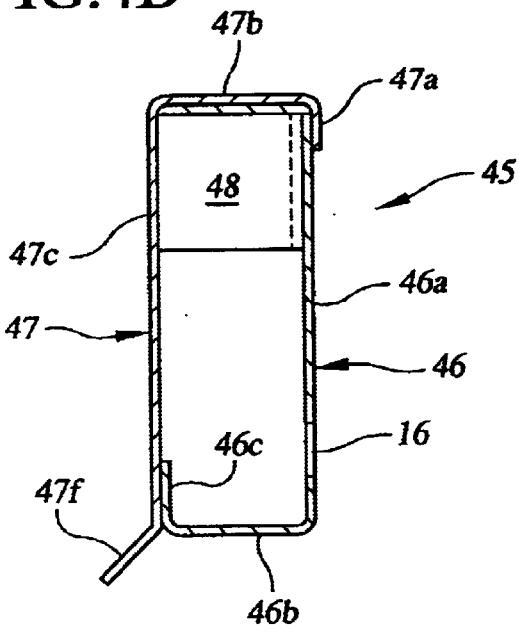
FIG. 4B shows a cross-sectional view of another frame member used to make a roof scuttle of the invention.

FIG. 4B shows another frame which may be used to make a roof scuttle of the invention. This frame is similar to the frame of FIG. 4 but does not have apron 47*d* and vertical flange 47*e*. Other configurations such as a drip flange positioned on wall 47*c*, e.g., at mid point, may be used as will be appreciated by those skilled in the art with the proviso that the frame have a flat lower wall for positioning the frame on a curb. The flat lower wall of the frame is an important feature of the invention since it allows the roof scuttle to be positioned on any size curb as will be shown hereinbelow.

Figure 4C:
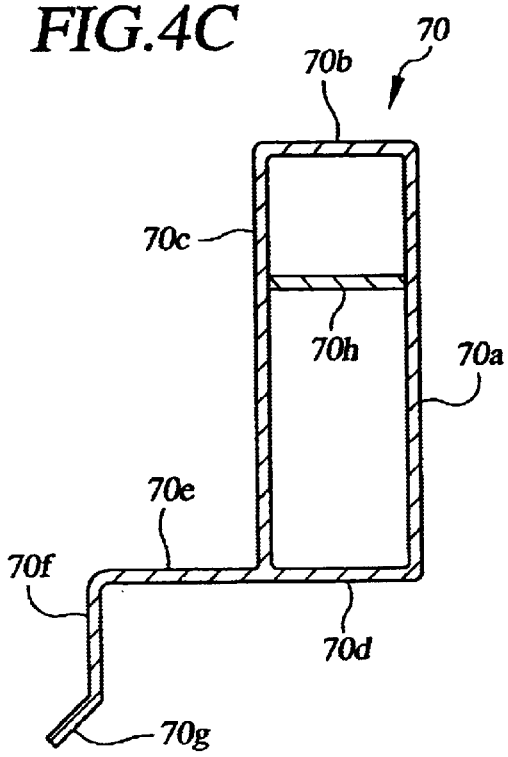
FIG. 4C shows a cross-sectional view of an extruded frame member used to make a roof scuttle of the invention.

FIG. 4C shows an extruded frame as numeral 70. The frame has opposed vertical side walls 70*a* and 70*c* and opposed horizontal connecting walls 70*b* and 70*d*, an apron 70*e*, vertical flange 70*f* and drip edge flange 70*g*. An integral spacer is shown as 70*h*.

While the thickness of the stock used to make the frames may vary widely, typically steel sheet will have a thickness up to about ¼ inch, e.g., between 1/16 and ⅛ inch, and aluminum also up to about ¼ inch, e.g., 3/32 inch.

Figure 5:
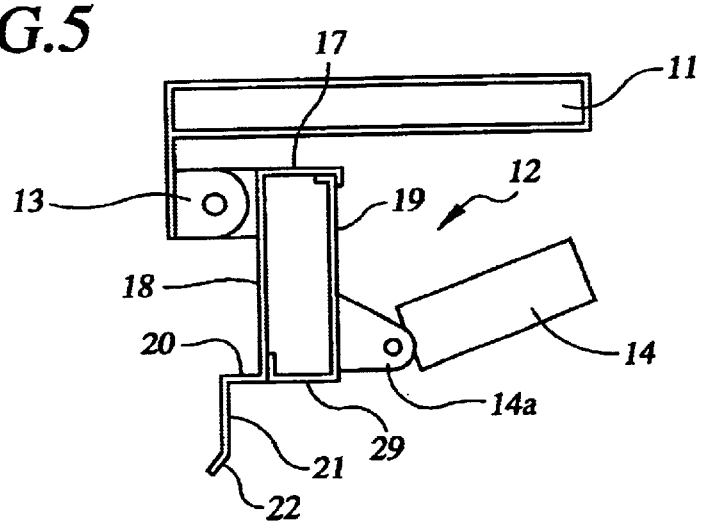
FIG. 5 is a schematic elevational view of a frame member and door of a roof scuttle of the invention.

FIG. 5 shows a schematic elevational view of the roof scuttle of the invention. The door 11 is hingedly mounted by hinge 13 to scuttle frame 12. A spring lift mechanism 14 is rotably mounted at one end to the frame 12 by bracket 14*a* and is used to facilitate opening and closing the door of the roof scuttle. Frame 12 is shown as comprising an inner wall 19, an outer wall 18, connecting curb 17 and connecting lower wall 29. Horizontal apron 20, vertical flange 21 and drip edge flange 22 complete the frame.

Figure 5A:
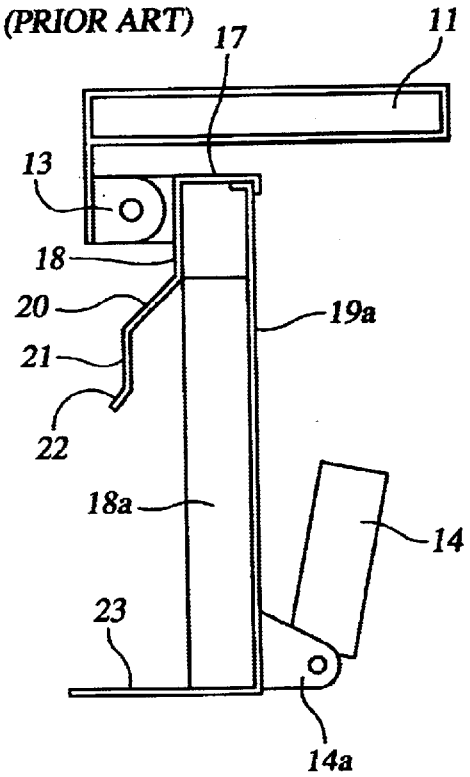
FIG.5A (PRIOR ART)
FIG. 5A is a schematic elevational view of a frame member and door of a roof scuttle of the prior art.

Comparing the roof scuttle of the invention of FIG. 5 to a conventional roof scuttle shown in FIG. 5A, the conventional roof scuttle comprises an inner wall 19*a* which has a 90° bend at the lower end thereof to form a nailing flange 23. The upper portion of the roof scuttle has a curb 17, an outer wall 18, flange wall 20, vertical wall 21 and drip edge flange 22. A curb 18*a* completes the frame. A hinge 13 connects the frame to the door and a spring lift mechanism 14 is shown rotably connected to inner wall 19*a* by bracket 14*a*.

Figure 5B:
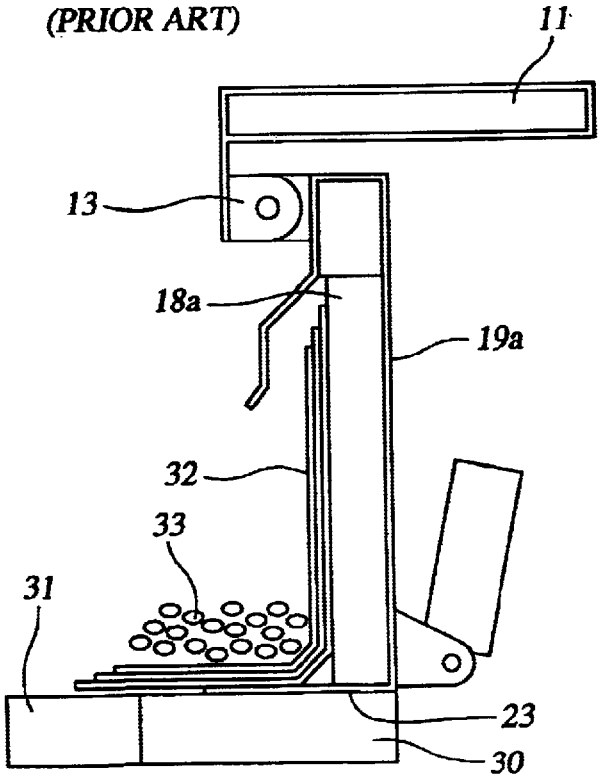
FIG.5B (PRIOR ART)
FIG. 5B is a schematic elevational view of the conventional roof scuttle of FIG. 5A installed on a roof with roofing material to waterproof the roof scuttle.

Referring to FIG. 5B, the roof scuttle of FIG. 5A is shown installed on a roof wherein the nailing flange 23 is secured to roof 30. Roof insulation is shown as numeral 31. Three sheets of roofing material shown in composite as 32 are laid on the roof and the outer wall 18*a* of the frame to seal the frame. Ballast 33 is shown as part of the roofing material. An elongated filler piece may be used to hold the roofing material as described in U.S. Pat. No. 5,960,596, supra. It should be appreciated that the installation of this type roof scuttle requires a skilled worker to properly apply the roofing material to waterproof the scuttle.

Figure 6:
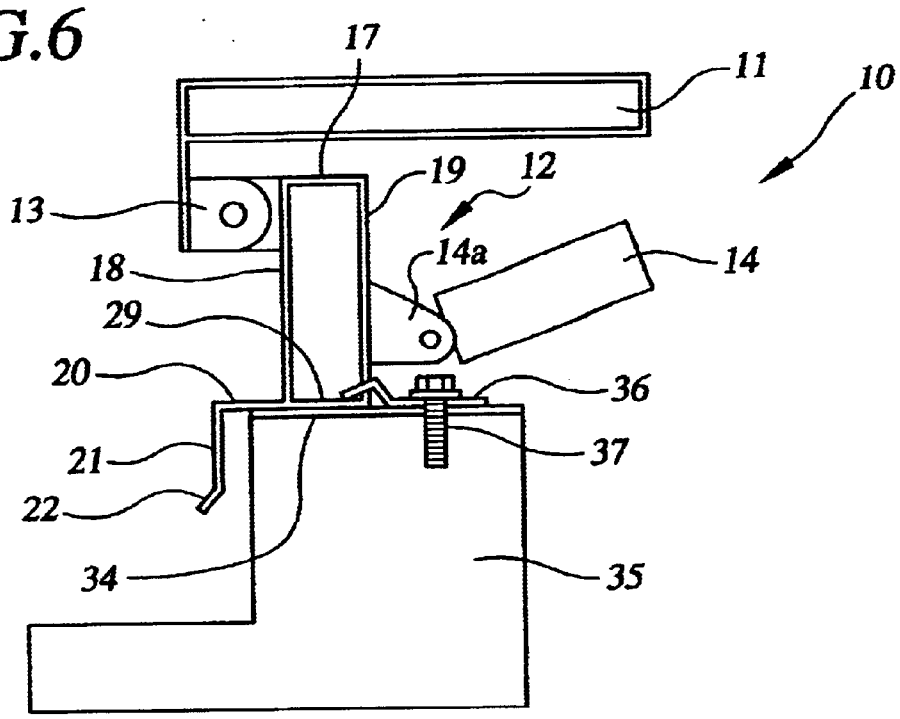
FIG. 6 is a schematic elevational view of a roof scuttle of the invention installed on a concrete curb.

FIG. 6 shows the installation of the roof scuttle 10 of the invention on a typical concrete curb 35. The frame shown generally as 12 is positioned on the curb so that the lower horizontal wall 29 of the frame rests on the surface of the curb 35 and the apron 20, flange 21 and drip edge flange 22 extend over the vertical wall of the curb. A sealant 34 is usually used between the top of the curb and the bottom wall 29 of the frame. One end of an anchor strap 36 is inserted in the opening in inner wall 19 of frame 12 and the other end of the anchor strap is secured by a bolt or other fastener 37 to the concrete curb 35. This is an example of a horizontal mount.

It will be understood by those skilled in the art that if the concrete curb base has a thickness about the same as the width of the frame 12, the anchor strap 36 may be placed in the opening in the frame and then positioned vertically and mounted by a bolt 37 to a vertical wall of the concrete curb. Such a vertical mount is shown in FIG. 11B for example.

Figure 7:
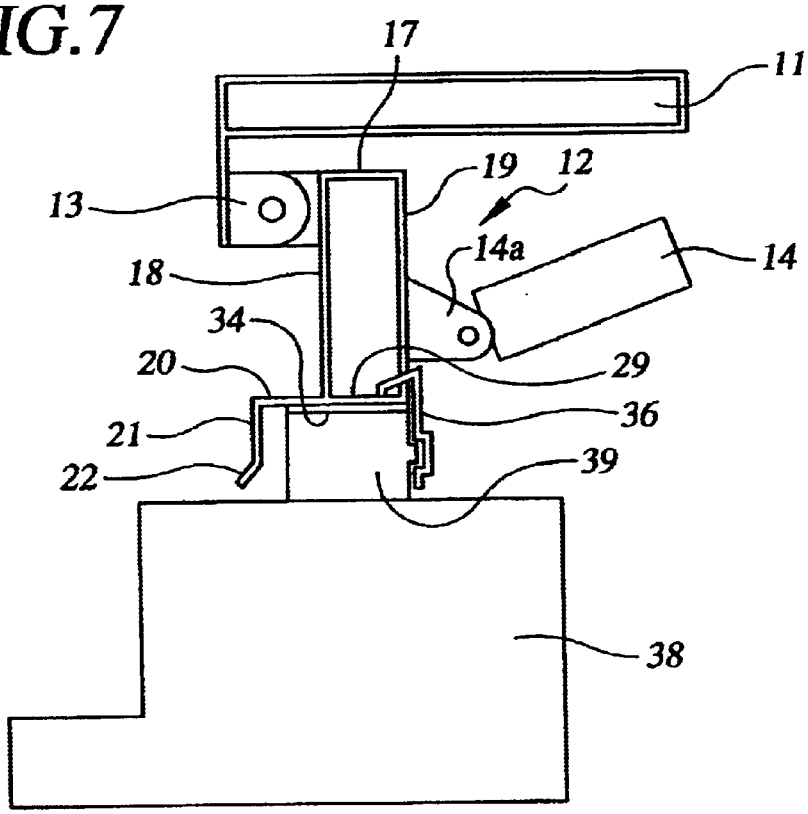
FIG. 7 is a schematic elevational view of a roof scuttle of the invention installed on an extra-wide concrete curb using a wood frame to secure the roof scuttle to the concrete curb.

FIG. 7 shows installation of a scuttle of the invention on an extra-wide concrete curb where the drip edge flange 22 would interfere with the lower wall 29 of the frame lying flat on the curb surface. The wooden frame 39 provided with the scuttle of the invention is secured to the upper surface of concrete curb 38 to form a curb. A sealant is typically used between the curb and frame. The lower wall 29 of frame 12 is then positioned on the wooden frame 39 and secured to the frame using an anchor strap 36. A roofing material and/or sealant 34 are provided as needed on the wooden frame 39 consistent with good roofing practice.

Figure 8:
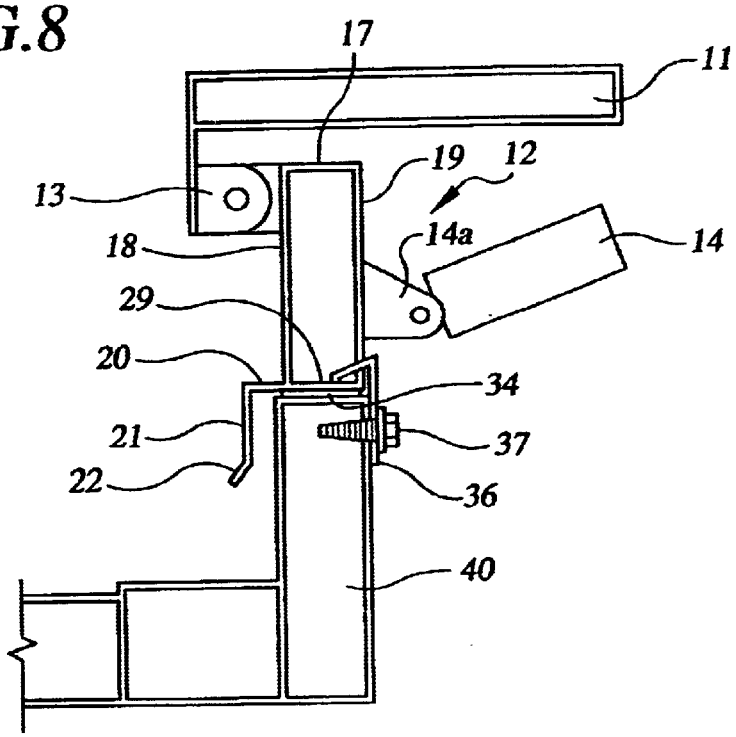
FIG. 8 is a schematic elevational view of a roof scuttle of the invention installed on a metal roof curb.

FIG. 8 shows installation of a roof scuttle of the invention on a metal roof having a metal curb 40. The lower wall 29 of the frame 12 is positioned on top of the metal frame 40 and anchor strap 36 is secured in the opening in the inner wall 19 and secured to the metal frame 40 by fastener 37. A sealant 34 is provided between the lower wall 29 of the frame and the top of the metal curb.

Figure 9:
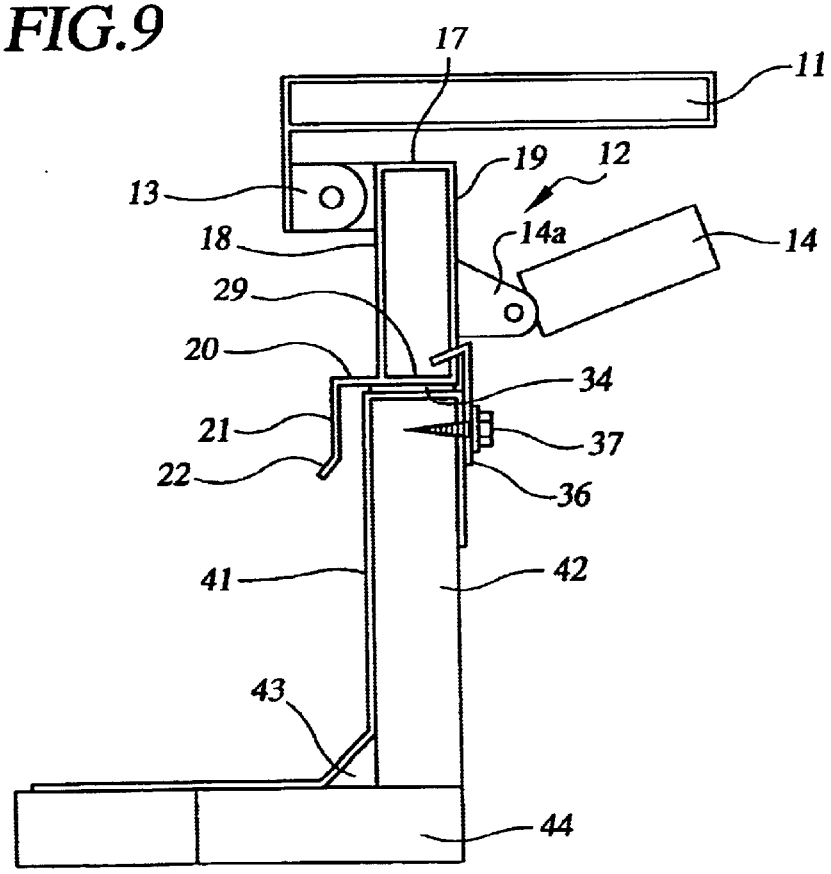
FIG. 9 is a schematic elevational view of a roof scuttle of the invention installed on a wood curb.

FIG. 9 shows installation of a roof scuttle of the invention on a wood curb made on the job site. The wood curb 42 is secured to roof 44 and a triangular shaped cant 43 used to form an angle to conform to NRCA standards. A roofing material 41 is laid on the surface of the roof 44 and extends up the cant and wall of the wood curb 42 over the top of the curb and partly down the inner wall of the curb. This provides a waterproof seal for the wood curb. The lower wall 29 of the roof scuttle 12 of the invention is then positioned on top of the wood curb and roofing material and the frame 12 secured by anchor strap 36 to the inner wall 19 of frame 12 and wood curb 42 by screw 37. A sealant 34 is typically used between the lower wall 29 of the frame and roofing material 41.

Figure 10:
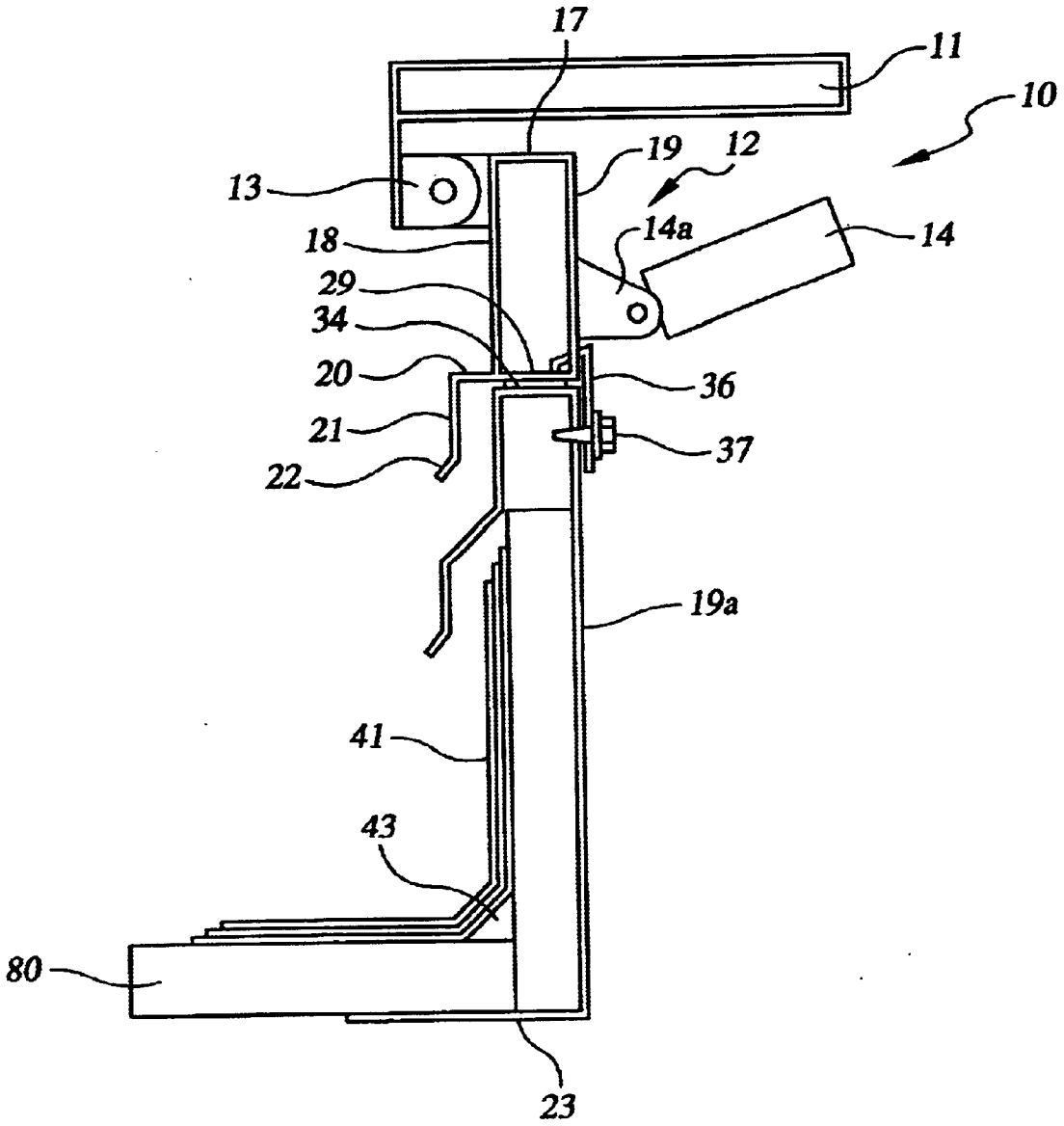
FIG. 10 is a schematic elevational view of a roof scuttle of the invention retrofitted on an existing roof scuttle curb without disturbing the roof seal.

FIG. 10 shows the retrofitting of the roof scuttle 10 of the invention on an existing roof scuttle curb. The cover of the old roof scuttle and all hardware has been removed leaving the frame of the roof scuttle shown as having inner wall 19*a* and horizontal nailing flange 23 and insulation 80. As can be seen, roofing material 41 is still in place so that the roof seal has not been disturbed. A sealant 34 is used on top of the old roof scuttle curb and the lower wall 29 of the roof scuttle frame 12 of the invention is positioned on the curb and secured to the scuttle frame wall 19 and inner wall 19*a* of the curb by anchor strap 36 being inserted in the opening in frame 19 and the other end of the strap fastened to inner wall 19*a* by screw 37.

Figure 11A:
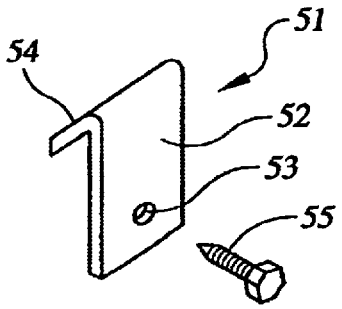
FIGS. 11A and 12A are perspective views of exemplary anchor straps which may be used to secure the roof scuttle of the invention to a curb on a roof.
Figure 11B:
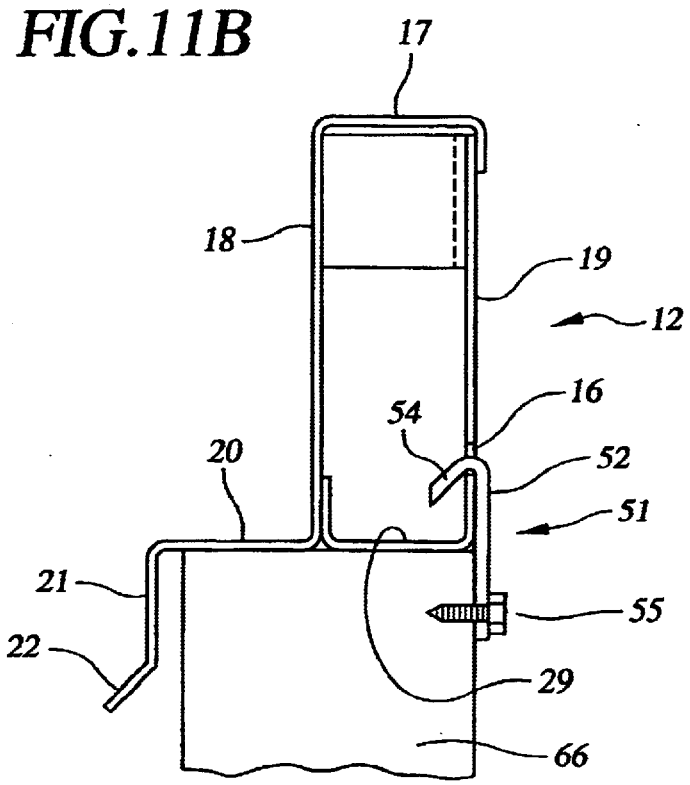
FIGS. 11B and 12B are elevational views of a roof scuttle of the invention secured to a roof curb using the anchor straps of FIGS. 11A and 12A.
Figure 12A:
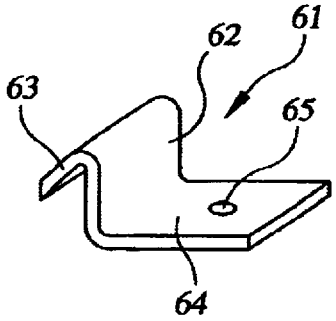
Figure 13A:
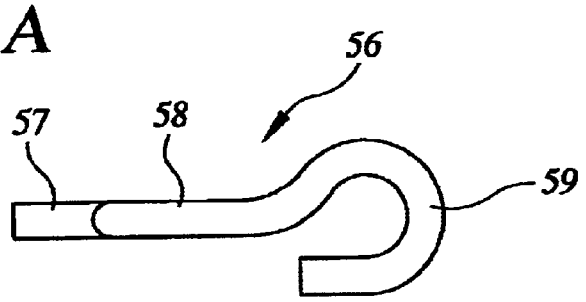
FIGS. 13A and 13A' are plan and elevational views, respectively, of another exemplary anchor strap.
Figure 13A:
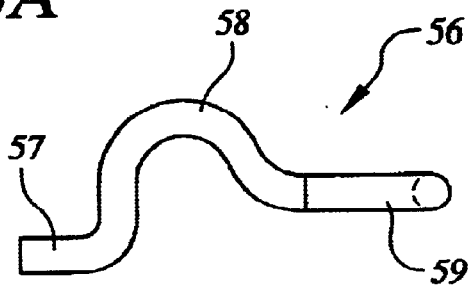

FIGS. 11A, 12A and 13A show exemplary anchor straps which may be used to secure the roof scuttle to the curb on the roof. Any suitable anchor strap may be used. In FIG. 11A, anchor strap 51 comprises a flat vertical portion 52 and a downward angled upper portion 54. A hole 53 in flat portion 52 accommodates a screw or other fastener 55. As shown in FIG. 11B, to use the anchor strap, the upper portion 54 is inserted in an opening 16 in the inner wall 19 of the frame and the lower portion secured to the roof curb 66 by fastener 55. This type anchor strap is used for a vertical mount.

FIG. 12A shows an anchor strap like that of FIG. 11A adapted for a horizontal mount. The anchor strap 61 comprises a middle vertical portion 62, upper angled portion 63 and a horizontal portion 64. An opening 65 accommodates a fastener such as a nail.

Figure 12B:
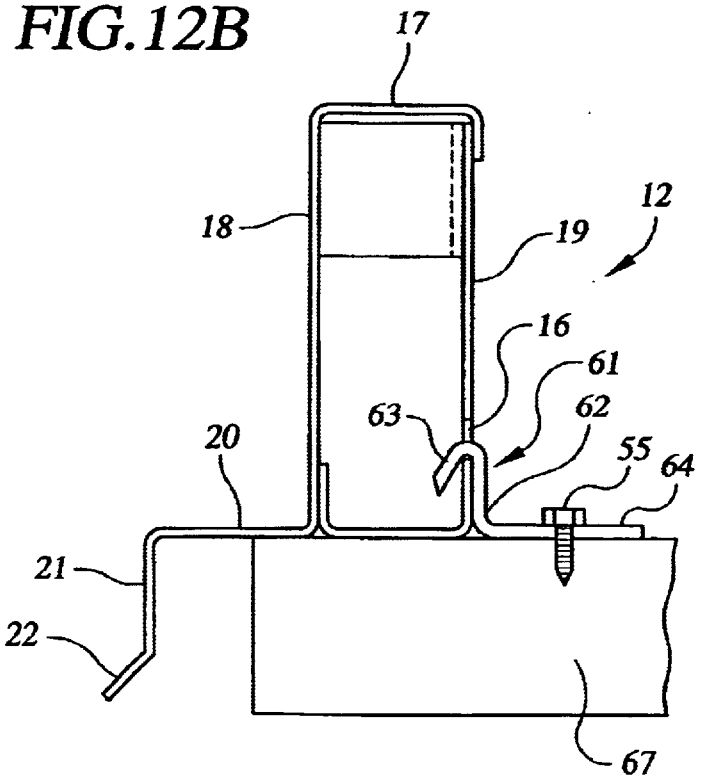

In FIG. 12B, the upper angled portion 63 of the anchor strap is positioned in opening 16 and the flat horizontal portion 64 secured to curb 67.

Figure 13B:
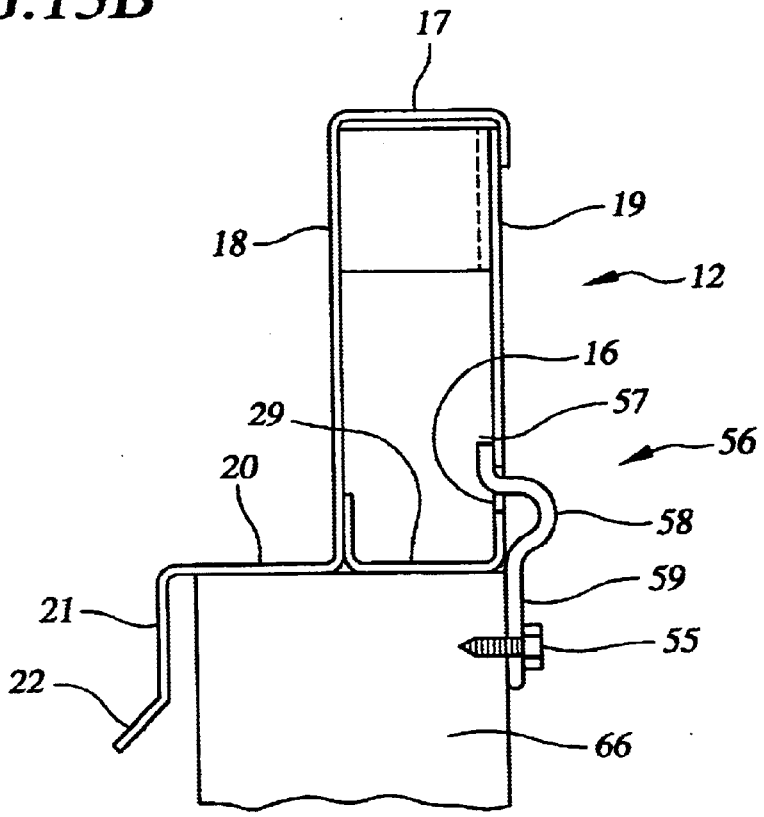
FIG. 13B is an elevational view of a roof scuttle of the invention secured to a roof curb using the anchor strap of FIGS. 13A and 13A'.

Another anchor strap is shown as numeral 56 in FIGS. 13A and 13A' and comprises a U-shape rod having a short leg 57, U-shape 58 and off-set loop 59. Loop 59 is secured to the curb using a fastener such as a screw. As seen in FIG. 13B, the short leg 57 is inserted in the opening 16 in the frame and the loop 59 secured to the roof curb in a vertical mount.

It will be appreciated by those skilled in the art that any type fastener may be used to secure the frame to the curb. With the above fastener, the angled leg 54, for example, may be inserted upward in the frame opening and the flat portion 52 reformed when fastened to the curb to fit the curb.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A roof scuttle for enclosing a roof opening comprising:

a plurality of elongate rectangular shaped frame members having a vertical outer wall and an opposed vertical inner wall and a connecting horizontal upper wall and a connecting horizontal lower wall and a downwardly and outwardly angled drip flange extending outwardly from the vertical outer wall and having an end which extends below the plane of the horizontal lower wall, which said frame members are connected together to form a rectangular scuttle frame, the scuttle frame having a front and a back and two opposed sides and which scuttle frame surrounds an opening on a roof to be covered by the roof scuttle and a raised curb surrounds the roof opening wherein the upper surface of the curb is above the roof surface;

a joiner frame extending around the lower wall of the rectangular scuttle frame and which joiner frame forms the raised curb on which the lower wall is positioned or is used to protect the frame during shipping;

a hinge;

a door having a top, bottom and side edges, said door being hinged to the frame for motion of the door between an open position and a closed position; and wherein the lower wall of the frame member is positioned on the upper surface of the raised curb surrounding the roof opening and the vertical inner wall of the scuttle frame is secured to the curb.

2. The roof scuttle of claim 1 which frame member is formed from two pieces of sheet metal which are secured together.

3. The roof scuttle of claim 1 which is formed by extrusion.

4. A roof scuttle for enclosing a roof opening comprising:

a plurality of elongate rectangular shaped frame members having a vertical outer wall and an opposed vertical inner wall which has openings therein to facilitate securing an anchor strap to the wall and a curb with a fastener and a connecting horizontal upper wall and a connecting horizontal lower wall and a downwardly and outwardly angled drip flange along the vertical outer wall, which said frame members are connected together to form a rectangular scuttle frame, the scuttle frame having a front and a back and two opposed sides which frame surrounds an opening in a roof to be covered by the roof scuttle and a raised curb surrounds the roof opening wherein the upper surface of the curb is above the roof surface;

a hinge;

a door having a top, bottom and side edges, said door being hinged to the frame for motion of the door between an open position and a closed position; and wherein the lower wall of the frame member is positioned on the upper surface of the raised curb surrounding the roof opening and the vertical inner wall of the scuttle frame is secured to the curb.

5. The roof scuttle of claim 4 wherein the openings are in the shape of slots.

6. The roof scuttle of claim 5 wherein the anchor strap is a flat strap having an angled upper portion for insertion in the frame opening.

7. The roof scuttle of claim 4 wherein the anchor strap is made from wire or rod.

8. A method for installing a roof scuttle to cover a roof opening comprising the steps of:

providing a raised curb surrounding a roof opening to be enclosed by a roof scuttle the upper surface of the curb being above the roof surface;

supplying a roof scuttle comprising:

a plurality of elongate rectangular shaped frame members having a vertical outer wall and an opposed vertical inner wall and a connecting horizontal upper wall and a connecting horizontal lower wall and a downwardly and outwardly angled drip flange extending outwardly from the vertical outer wall and having an end which extends below the plane of the lower wall, which said frame members are connected together to form a rectangular scuttle frame, the scuttle frame having a front and a back and two opposed sides and which frame surrounds the opening in the roof to be covered by the roof scuttle;

a hinge; and a door having a top, bottom and side edges, said door being hinged to the frame for motion of the door between an open position and a closed position;

positioning the lower wall of the roof scuttle on the upper surface of the raised curb; and securing an anchor strap horizontally or vertically to the vertical inner wall of the scuttle frame and to the curb.

9. The method of claim 8 wherein the curb is metal.

10. The method of claim 8 wherein the curb is the existing curb from a roof scuttle to be replaced.

11. A method for installing a roof scuttle to cover a roof opening comprising the steps of:

providing a raised curb surrounding a roof opening to be enclosed by a roof scuttle the upper surface of the curb being above the roof surface;

supplying a roof scuttle comprising:

a plurality of elongate rectangular shaped frame members having a vertical outer wall and an opposed vertical inner wall wherein the inner wall has openings to facilitate securing an anchor strap to the wall with a fastener and a connecting horizontal upper wall and a connecting horizontal lower wall and a downwardly and outwardly angled drip flange along the vertical outer wall, which said frame members are connected together to form a rectangular scuttle frame, the scuttle frame having a front and a back and two opposed sides and which frame surrounds the opening in the roof to be covered by the roof scuttle;

a hinge; and a door having a top, bottom and side edges, said door being hinged to the frame for motion of the door between an open position and a closed position;

positioning the lower wall of the roof scuttle on the upper surface of the raised curb; and securing the vertical inner wall of the scuttle frame to the curb using the anchor strap.

12. The method of claim 11 wherein the openings are slots.

13. The method of claim 12 wherein the anchor strap is a flat strap having an angled upper portion for insertion in the opening.

14. The method of claim 11 wherein the openings are circular.

15. The method of claim 14 wherein the anchor straps are made from wire or rod.

16. The method of claim 8 wherein the roof scuttle further comprises a joiner frame extending around the lower wall of the rectangular scuttle frame, the joiner frame being used to protect the scuttle frame during shipping or to form the raised curb on which the frame is secured wherein the lower wall of the roof scuttle frame is positioned on the upper surface of the joiner frame and the inner wall of the scuttle frame is secured to the curb formed by the joiner frame.

* * * * *